US012781529B1

(12) United States Patent
Onishenko

(10) Patent No.: US 12,781,529 B1
(45) Date of Patent: Nov. 3, 2026

(54) ADJUSTABLE FOOT POST BASE

(71) Applicant: Victor Onishenko, Rogers, AR (US)

(72) Inventor: Victor Onishenko, Rogers, AR (US)

( * ) Notice: Subject to any disclaimer, the term of this patent is extended or adjusted under 35 U.S.C. 154(b) by 47 days.

(21) Appl. No.: 18/927,054

(22) Filed: Oct. 25, 2024

Related U.S. Application Data

(63) Continuation-in-part of application No. 29/836,337, filed on Apr. 26, 2022, now Pat. No. Des. 1,054,068.

(51) Int. Cl.
*E04H 12/22* (2006.01)

(52) U.S. Cl.
CPC ..... *E04H 12/2284* (2013.01); *E04H 12/2238* (2013.01); *E04H 12/2269* (2013.01)

(58) Field of Classification Search
CPC ..... E04H 12/2284; E04H 12/2238; E04H 12/2269
See application file for complete search history.

(56) References Cited

U.S. PATENT DOCUMENTS 3,279,133 A 10/1966 Korte
4,793,111 A 12/1988 Shewchuk
5,029,820 A 7/1991 Katz
5,568,909 A * 10/1996 Timko ..... E04H 12/2269 52/298
6,745,529 B2 6/2004 Beltran
7,001,098 B2 * 2/2006 Lin ..... E04F 15/02452 403/194
8,240,097 B2 8/2012 Day
8,544,924 B2 * 10/2013 Inda ..... B66C 1/108 294/215
8,757,598 B1 6/2014 Jones
8,919,741 B2 12/2014 Sadinsky
9,487,965 B2 11/2016 Volin
10,030,367 B2 * 7/2018 Dare ..... E02F 9/2883
10,378,232 B2 * 8/2019 Volin ..... E04H 12/2261
2009/0180831 A1 * 7/2009 Kendall ..... F16B 5/025 403/408.1
2013/0061453 A1 * 3/2013 Rosendahl ..... E04H 5/04 29/428

* cited by examiner

*Primary Examiner* — Anita M King
(74) *Attorney, Agent, or Firm* — Keisling & Pieper PLC; Trent C. Keisling; David B. Pieper

(57) ABSTRACT

An adjustable foot post base with multiple lifting rams is provided allowing independent positioning of the post base and ram support structure with a socket wrench before installation of a securing fastener. A recessed socket lifting ram is provided to adjustably extend from the bottom of the post base body with the top of the recessed socket lifting ram fitting inside the base thread of the post base body for independent height adjustment between the ram and base. Similarly, a fastener with a head diameter that also fits inside the base thread of the post base ram body is provided for independent fastener height adjustment from the post base. The securing fastener can be further made to be independently positioned from the ram. Stacked ram bodies are provided which can be driven using through extending drive apertures.

18 Claims, 14 Drawing Sheets

ADJUSTABLE FOOT POST BASE

CROSS REFERENCE TO RELATED PATENTS AND APPLICATIONS

This application claims priority to and is a continuation-in-part of U.S. patent application Ser. No. 29/836,337, filed on Apr. 26, 2022 entitled ADJUSTABLE FOOT POST BASE which is hereby incorporated by reference in its entirety.

FEDERALLY SPONSORED RESEARCH AND DEVELOPMENT

Not applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

The present invention relates to improvements in mounting railing posts. More particularly, the invention relates to improvements particularly suited for providing a post base with additional capabilities for being a recessed post base under a floor or covering. In particular, the present invention relates specifically to a recessed-fastener ram-leveled post-base.

2. Description of the Known Art

As will be appreciated by those skilled in the art, posts, railings, and their supports are generally known in various forms. Patents disclosing information relevant to these areas include: U.S. Pat. No. 3,279,133, issued on Oct. 18, 1966 to De Korte; U.S. Pat. No. 4,793,111, issued on Dec. 27, 1988 to Shewchuk; U.S. Pat. No. 5,029,820, issued on Jul. 9, 1991 to Katz; U.S. Pat. No. 6,745,529, issued on Jun. 8, 2004 to Beltran; U.S. Pat. No. 8,240,097, issued on Aug. 14, 2012 to Day et al.; U.S. Pat. No. 8,757,598, issued on Jun. 24, 2014 to Jones; and U.S. Pat. No. 8,919,741, issued on Dec. 30, 2014 to Sadinsky et al.; and U.S. Pat. No. 9,487,965, issued on Nov. 8, 2016 to Volin. Each of these patents is hereby expressly incorporated by reference in their entirety.

From these prior references it may be seen that these prior art patents are very limited in their teaching and utilization, and an improved adjustable foot post base is needed to overcome these limitations.

SUMMARY OF THE INVENTION

The present invention is directed to an adjustable foot post base with improvements directed to a recessed-fastener, ram-leveled post base. In accordance with one exemplary embodiment of the present invention, a post support is provided for mounting a post on a surface. The post support uses a post ram pedestal with a base body. Starting at a base top, the base body defines a threaded securing aperture having a base thread. Mounted into the threaded securing aperture is a recessed socket lifting ram. The recessed socket lifting ram has external socket ram threads sized to mate with the base thread so that when the recessed socket lifting ram is turned, it adjustably extends from the bottom of the base body. The recessed socket lifting ram has a socket body with a maximum body diameter fitting inside the base thread, and a socket top defining a drive shape. Because the maximum body diameter fits inside the base thread, and the drive shape is formed into the socket top, the recessed socket lifting ram can be positioned with the socket top above the base, at the base top, or below the base top as needed. Furthermore, the socket body defines a center pass through which allows a fastener to secure the post base to the surface. If the fastener has a head diameter that also fits inside the base thread, the head of the fastener can also be recessed below the base top. This allows for the base top to be planar and simplifies the installation of flooring or other material over the base top of the adjustable foot post base. Thus, the ideal is to have no projections above the base top.

The adjustable post base may include multiple securing apertures and multiple recessed socket lifting rams to provide a wide stable surface and planar adjustability and support of the adjustable post base.

In the recessed socket lifting ram, the center pass aperture can form at least a portion of the drive shape and may have the drive shape extending all of the way through the base body. In this case, multiple socket bodies can be stacked and driven together from the top side of the uppermost socket body for additional height adjustability.

If threads are used for the drive shape, then the base body includes a stop shoulder on the base top that contacts a drive shoulder on a drive wrench.

Still further, when using the threaded connection of the fastener to the ram, the fastener can have a recessed drive aperture that fits inside the fastener's shank diameter so that the fastener's head top can be positioned above, below, or at the base top, and above, below, or at the socket top. This means that the height of the head top of the fastener, height of the socket top of the ram, and height of the base top of the base body are all completely independent and adjustable in relation to each other. The threaded connection of the fastener to the ram also means that multiple ram bodies may be connected to the same fastener in a stacked formation.

These and other objects and advantages of the present invention, along with features of novelty appurtenant thereto, will appear or become apparent by reviewing the following detailed description of the invention.

BRIEF DESCRIPTION OF DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
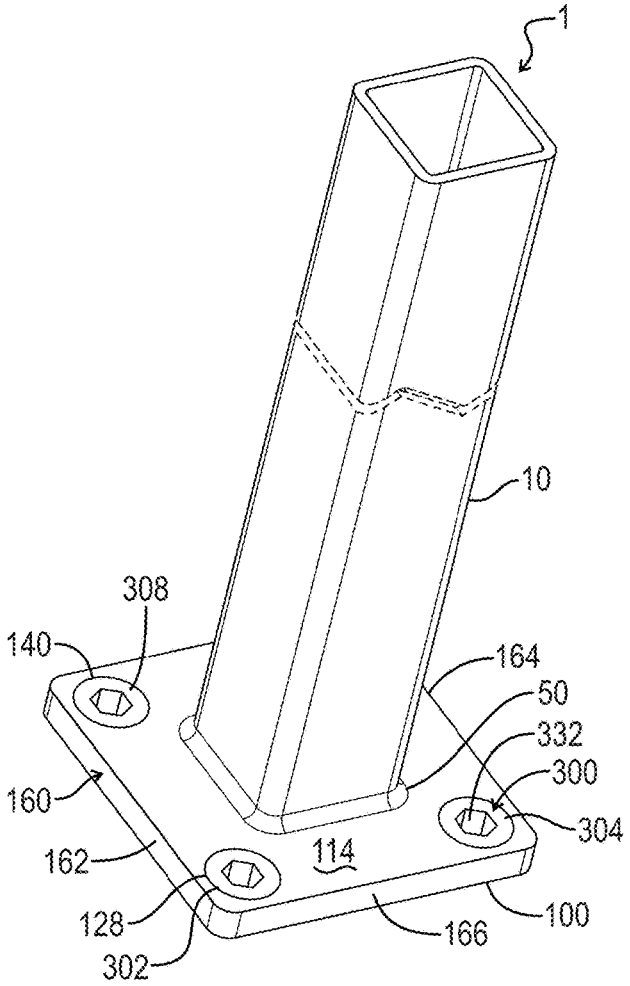
FIG. 1 is a perspective view of an adjustable foot post base showing my new design.
Figure 2:
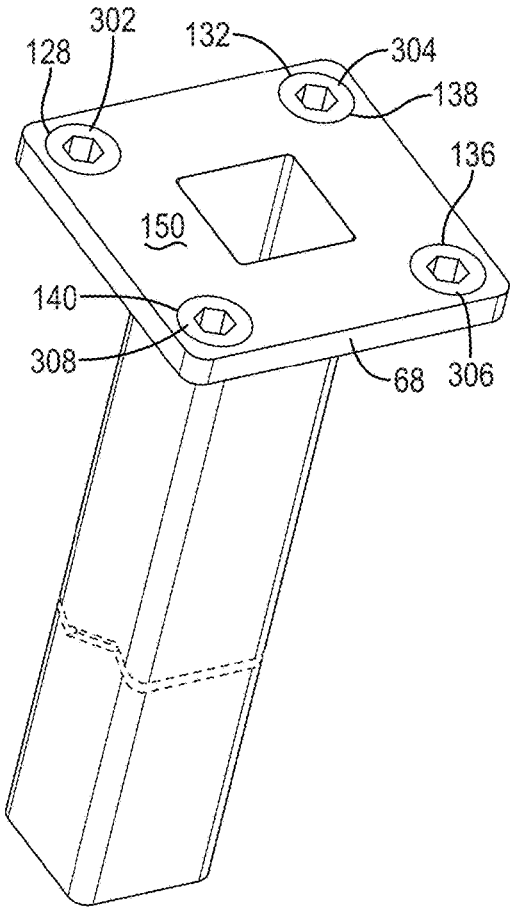
FIG. 2 is another perspective view thereof.
Figure 3:
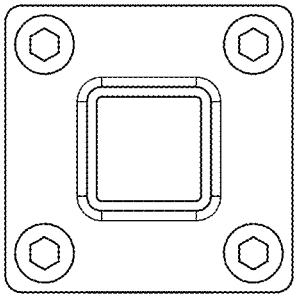
FIG. 3 is a top view thereof.
Figure 5:
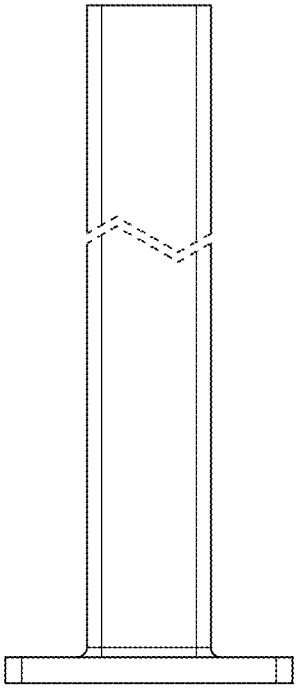
FIG. 5 is a front view thereof.
Figure 4:
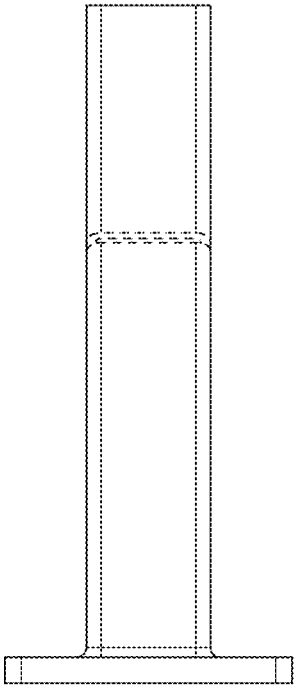
FIG. 4 is a right side view thereof.
Figure 6:
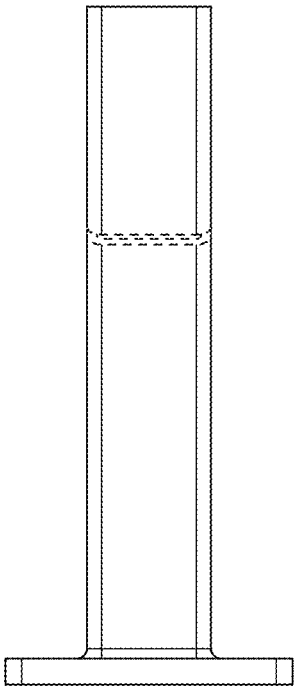
FIG. 6 is a left side view thereof.
Figure 8:
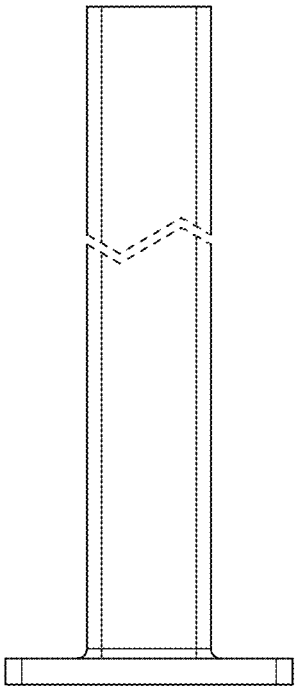
FIG. 8 is a back view thereof.
Figure 7:
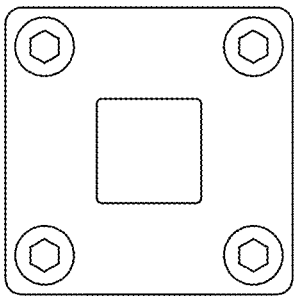
FIG. 7 is a bottom view thereof.

As shown in FIGS. 1 through 19 of the drawings, one exemplary embodiment of the present invention is generally shown as an adjustable post base 1. The adjustable post base 1 includes a support post 10 mounted with a connecting weld 50 to a post ram pedestal 100. The post ram pedestal 100 includes recessed securing apertures 122 for mounting recessed socket lifting rams 300 using a drive wrench 200. A securing fastener 350 can then be driven through a center pass through 324 in the recessed socket lifting rams 300.

The support post 10 includes a post body 12 extending from a post base 14 vertically using an exterior wall 16 with a hollow core aperture 18 to a post top 20. The post body 12 is typically a two inch square tube of steel with a one-quarter to three eights inch wall thickness with these values designed according to the height and stability requirements for the support post 10. The connecting weld 50 is a typical steel weld between the support post 10 and the post ram pedestal 100 that is also made of steel.

The post ram pedestal 100 is made with a base body 110. The base body 110 has a body depth 112 extending from a base top 114 to a base bottom 150 across a base side 160. The base top 114 defines a top central pad 116 having a post connection area 118 for the connecting weld 50 and an outwardly extending top mounting deck 120 defining recessed securing apertures 122. Each recessed securing aperture 122 has an aperture diameter 124 and an aperture depth 126. The aperture depth 126 is preferably equal to the body depth 112 to allow the ram 300 to be installed from above and extend out the base bottom 150 of the base body 110. In the preferred embodiment shown, there is a first aperture 128 with a first internal base ram thread 130, a second aperture 132 with a second internal base ram thread 134, a third aperture 136 with a third internal base ram thread 138, and a fourth aperture 140 with a fourth internal base ram thread 142. The body side 160 forms a square with a base left 162, base right 164, base front 166, and a base back 68.

The recessed socket lifting rams 300 are implemented as a first screw ram 302, second screw ram 304, third screw ram 306, and fourth screw ram 308. Each ram 300 includes a socket body 310 having a body diameter 312, body height 314, socket top 315, lower support sole 316, and a socket side wall 318 defining external socket ram threads 320. The socket body 310 defines both a drive aperture 322 and a center pass through 324. The drive aperture 322 is a simple hex aperture in the preferred embodiment that also forms the center pass through 324, but anything that can be machined either into the center pass through 324 or machined into the socket top 315 can be used. Examples of the drive aperture include shapes such as Slotted: Slotted, Coin slot, Hi-Torque; Cruciform drives: Cross, Phillips, Pozidriv, Supa-driv, JIS B 1012, Phillips II, Frearson/Reed & Prince, French, recess, Torq-set, Mortorq; Square: Robertson; Multiple-square: LOX-Recess, Double-square, Triple-square, (XZN); Internal hex: Hex, socket, Double, hex; Pentalobular: Pentalobe, ASTER recess, Torx Plus Tamper-Resistant; Hexalobular: Torx, Torx Plus, Torx Paralobe, Torx ttap; Combination: Slotted/Phillips, Phillips/square, Slotted/Torx, Clutch; External: Hex, Square, Slotted Hex, Pentagon, External Torx, 12-point; and Tamper-resistant: Security Torx, Bristol, Line male, Line female, Line female anti-tamper, One-way, Oval, Polydrive (RIBE), Security hex, Spanner, 12-spline flange, Tri-angle, Tri-point, Tri-point-3, Tri-groove, Tri-wing, Galactic, Empire.

The center pass through 324 has a pass through diameter 326. The center pass through 324 can also be made with center threads 328 for some embodiments. For most of the shapes mention, the drive aperture 322 has a tool drive section 330 with a wrench drive wall 332 at the upper end 334

A drive wrench 200 is used to engage the drive aperture 322 and turn the socket body 310. The drive wrench 200 is made with a drive head 202 having a mating drive shape 204 that engages the drive aperture 322. The drive wrench 200 preferably has a head width 206 that is smaller than the aperture diameter 124 of the recessed securing apertures 122. The drive wrench 200 may also have a drive shoulder 208 having a shoulder diameter 210 sized between the recessed drive aperture 356 of the fastener head 352 and the smaller than the aperture diameter 124 of the recessed securing apertures 122.

The securing fastener 350 is used to secure the socket lifting ram 300 to the surface 2. The securing fastener 350 is generally a screw or threaded bolt with a fastener head 352 having a head diameter 354 and a recess drive aperture 356, an elongated fastener body 360 having a body diameter 362 and fastener screw threads 364, and a fastener penetrating tip 366. The preferred embodiment uses a first securing fastener 371, second securing fastener 372, third securing fastener (not shown), and fourth securing fastener 374.

Figure 9:
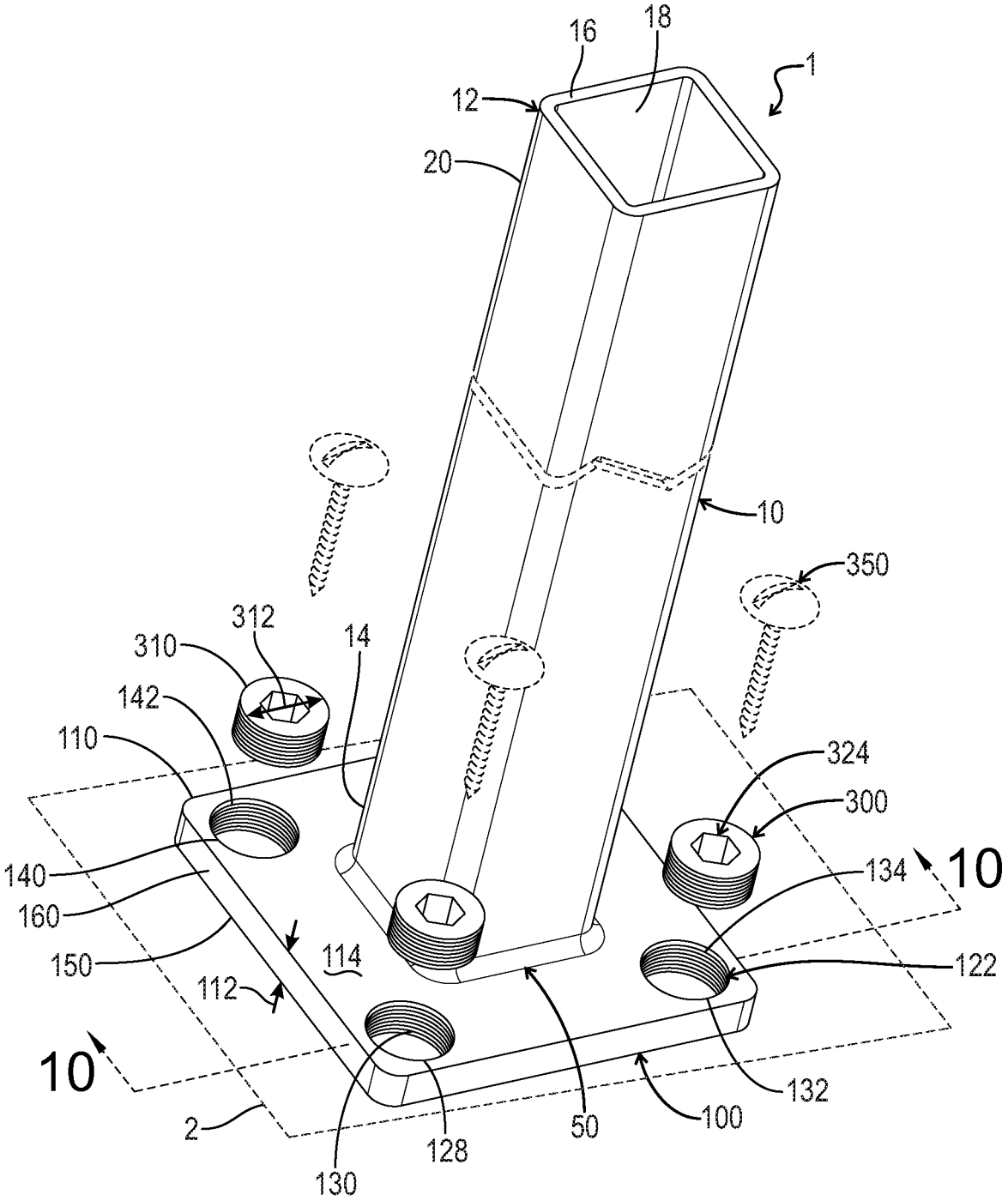
FIG. 9 is another perspective view thereof showing the recessed socket lifting ram removed.
Figure 10:
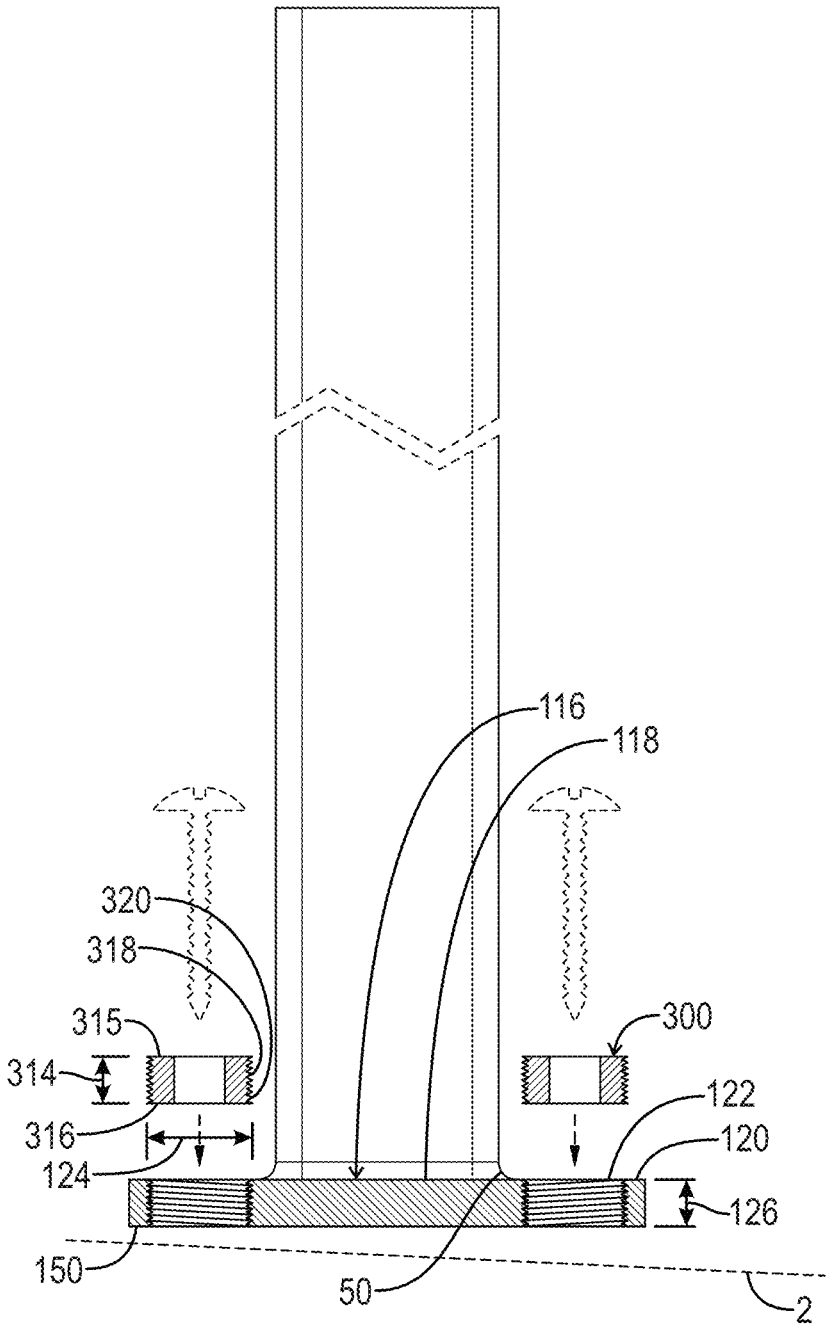
FIG. 10 is a cutaway view along line A-A of FIG. 9.
Figure 11:
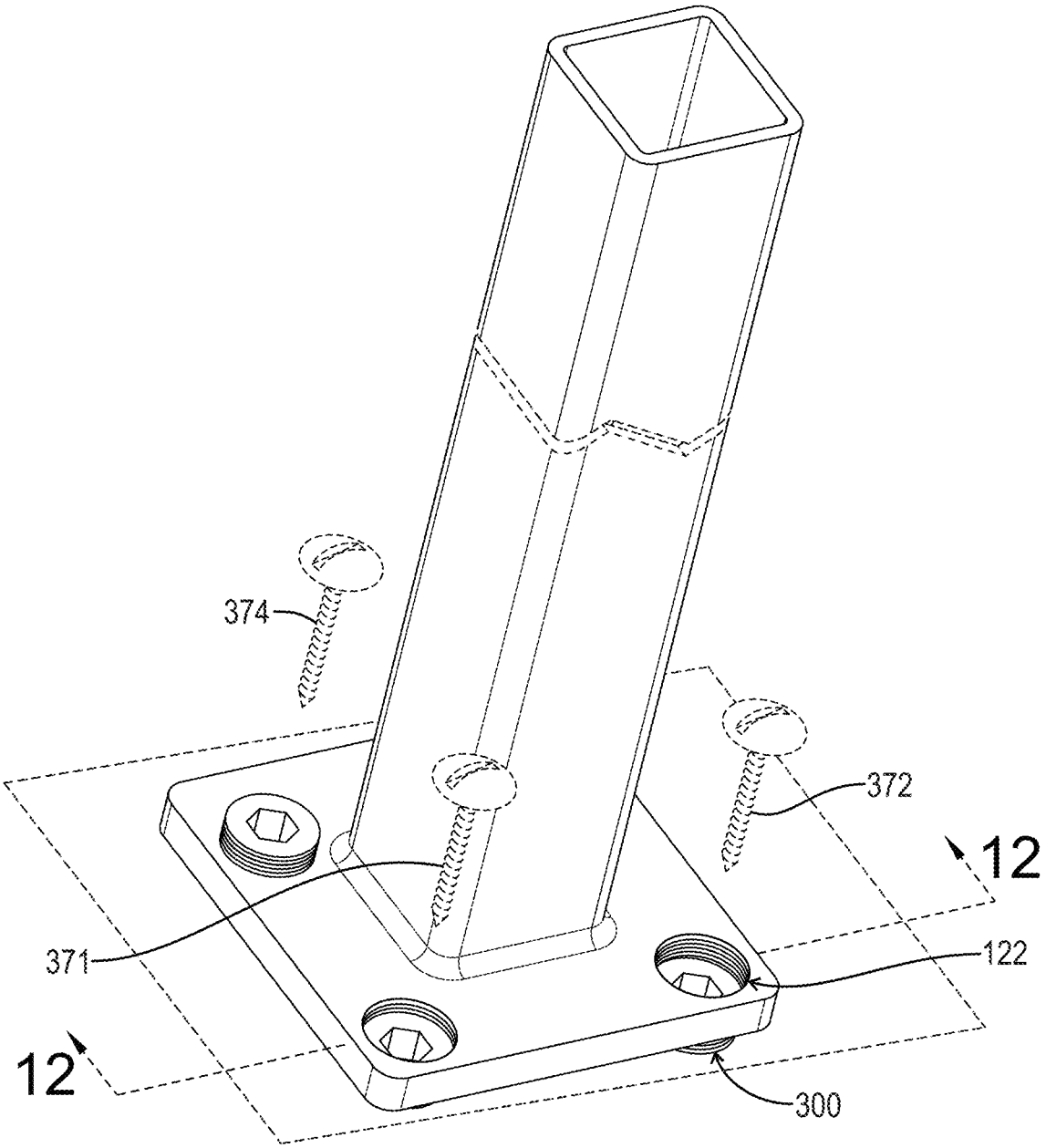
FIG. 11 is another perspective view thereof showing positions of the recessed socket lifting ram.
Figure 12:
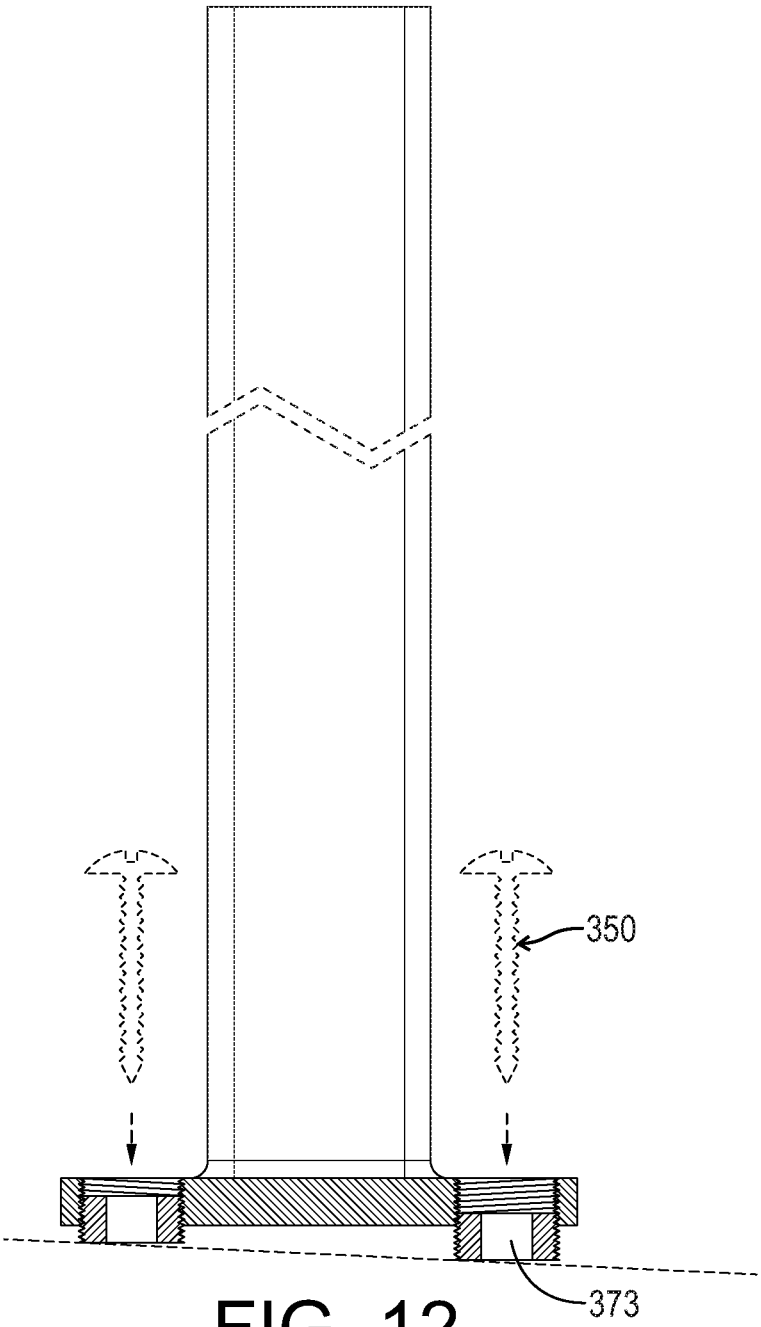
FIG. 12 is a cutaway view along line B-B of FIG. 11.
Figure 13:
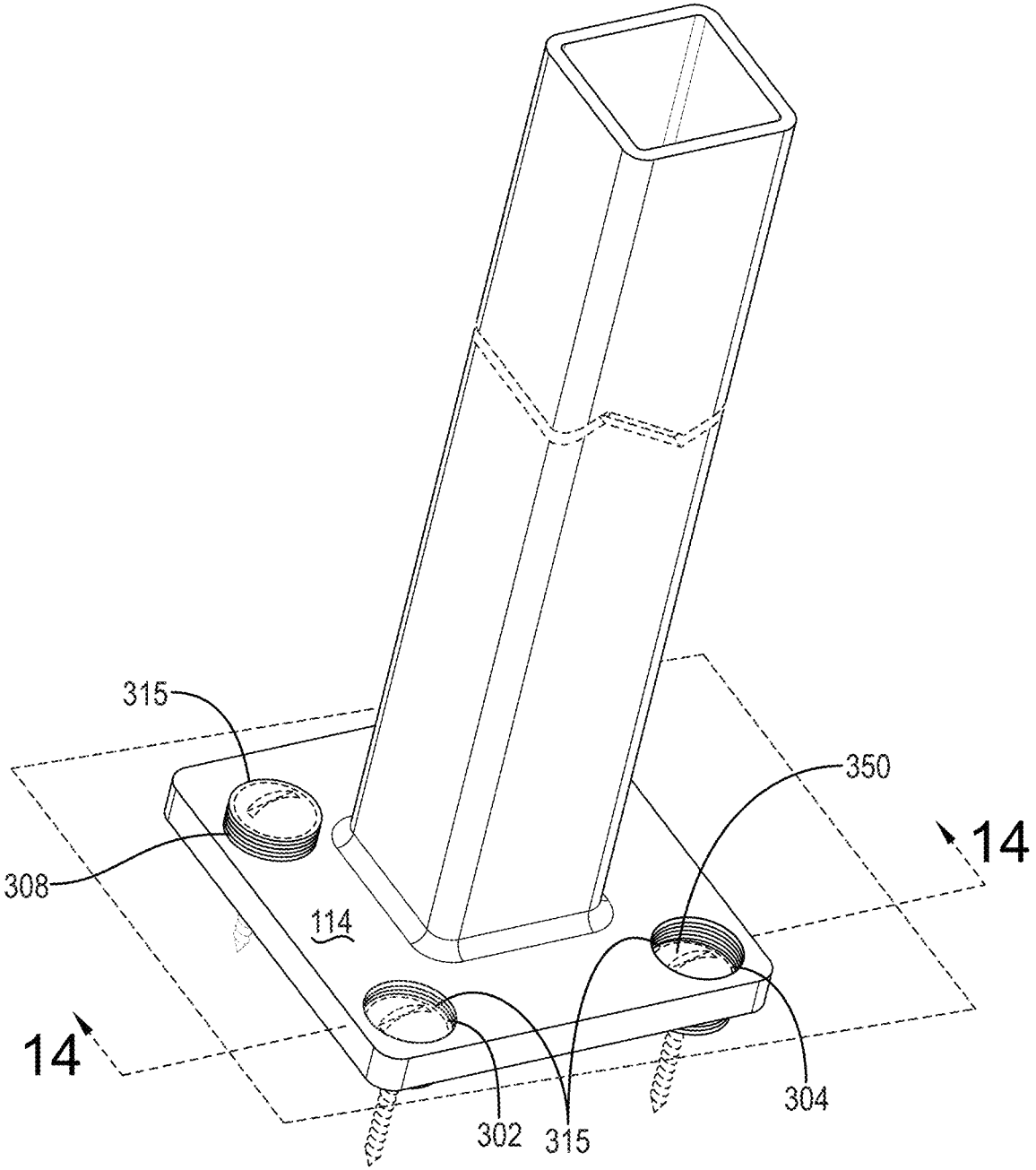
FIG. 13 is another perspective view thereof showing the ram adjusted.
Figure 14:
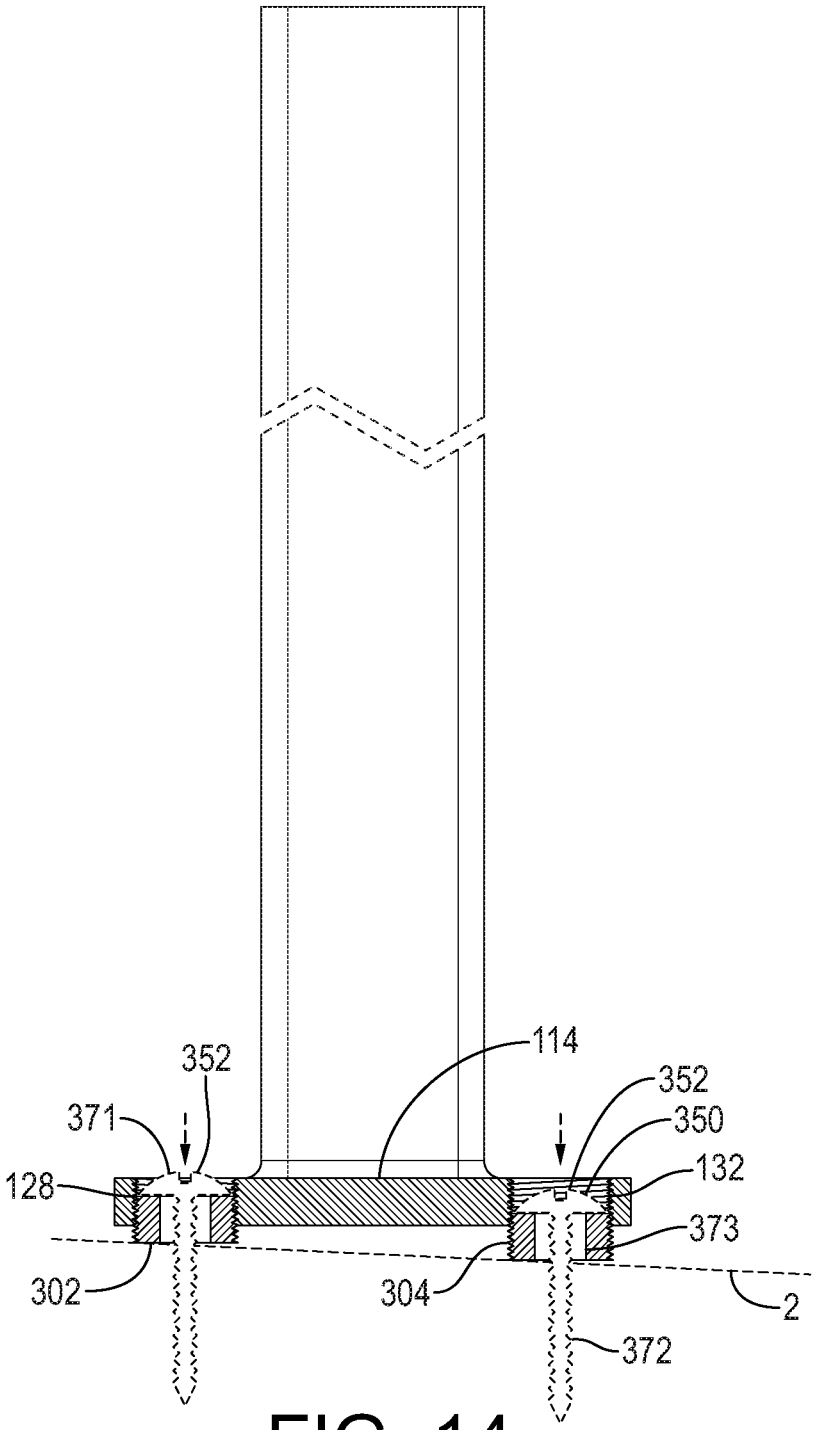
FIG. 14 is a cutaway view along line A-A of FIG. 13.

FIGS. 9-14 show a perspective view of the installation of an adjustable post base 1 onto a surface 2. FIG. 9 shows the securing fastener 350 positioned above the recessed socket lifting ram 300 which is positioned above the recessed securing apertures 122 in the base body 110 which is positioned above the unlevel surface 2. The recessed socket lifting ram 300 is shown with a drive aperture 322 in a hex shape showing use of a wrench drive wall 332 passing all the way through the socket body 310 to form the center pass through 314. FIG. 10 is a cutaway view along line A-A of FIG. 9. FIG. 11 then shows the recessed socket lifting ram 300 threadably mounted in the recessed securing apertures 122. FIG. 12 is a cutaway view along line B-B of FIG. 11. FIG. 13 then shows the securing fasteners 350 being installed through the center pass through 314 and into the surface 2 to secure the recessed socket lifting ram 300 to the surface 2 which thereby secures the base body 110 to the surface 2 as well. FIG. 14 is a cutaway view along line A-A of FIG. 13.

Note in FIG. 14 how the first screw ram 302 positions the first securing fastener 371 and its fastener head 352 within the first recessed securing aperture 128 in an at least partially recessed position below the base top 114. Also note in FIG. 14 how the second screw ram 304 positions the second securing fastener 372 and its fastener head 352 within the second recessed securing aperture 132 completely below the base top 114. FIG. 13 shows the first screw ram 302 and second screw ram 304 installed with their socket tops 315 below the base top 114, and the fourth screw ram 308 with its socket top 315 positioned above the base top 114. Contrast this with FIG. 1 that shows first screw ram 302, second screw ram 304, and fourth screw ram 308 installed with the socket top 315 at the base top 114. Thus, the recessed socket lifting rams 300 can be height adjusted with the socket top 315 above, at, or below the base top 114.

Figure 15:
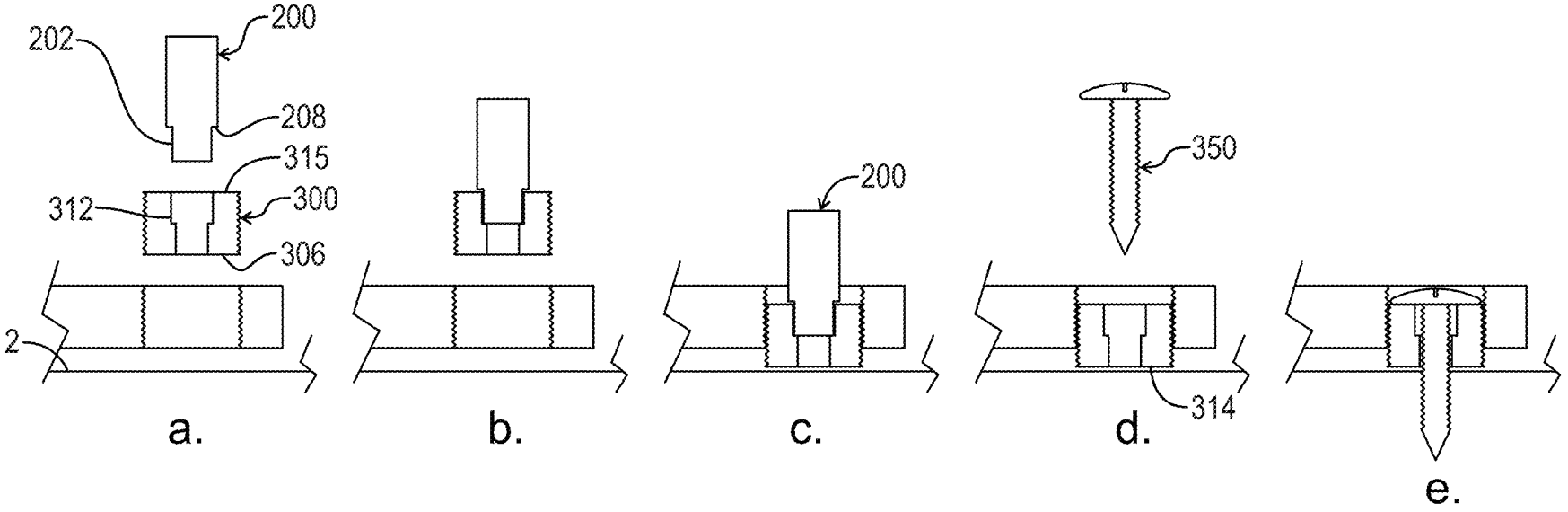
FIG. 15 shows a schematic cut away view of the progression during installation of the ram and fastener.

FIG. 15 shows a schematic cut away view of the progression during installation of the recessed socket lifting ram 300 and the securing fastener 350. FIG. 15*a* shows an exploded view of the items. In FIG. 15*b*, the drive wrench 200 engages the drive aperture 312 with the drive shoulder 208 engaging the socket top 315 thereby limiting the depth of the penetration of the drive head 202 into the drive aperture 312. This ensures that the lower support sole 306 is what engages the surface 2. In FIG. 15*c*, the drive wrench 200 rotates the ram 300 into the base 100. In FIG. 15*d*, the drive wrench 200 is removed and the securing fastener 350 is positioned, and in FIG. 15*e* the securing fastener 350 is installed through the center pass through 324 and into the surface 2 with the fastener head 352 engaging the socket top 315 so the ram 300 is trapped against the surface 2. The threads 130 in the base body 110 and the socket ram threads 320 now hold the base body 110 in position.

Figure 16:
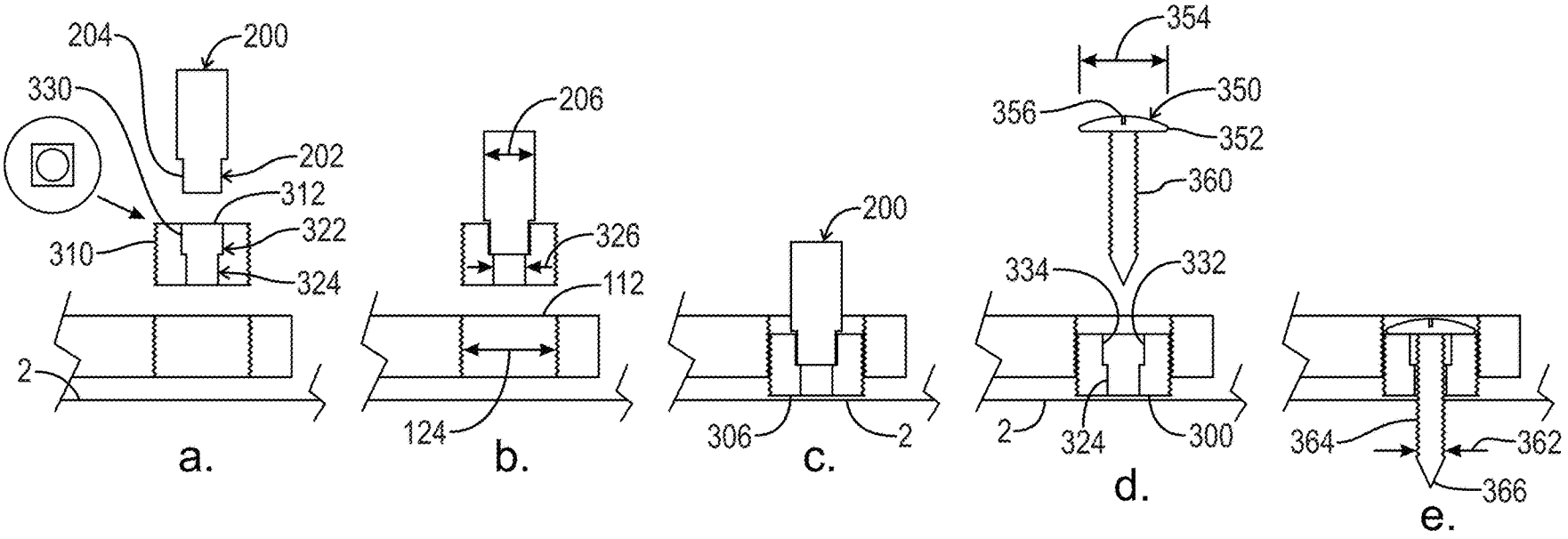
FIG. 16 shows another schematic cut away view of the progression during installation of the ram and fastener.

FIG. 16 shows another example where the drive aperture 322 is larger than the center pass through 324. We begin with an exploded view in 16*a* (a top view is also shown for clarity) onad FIG. 16*b* shows how the drive wrench 200 engages the drive aperture 312 with the drive shoulder 208 engaging the socket top 315 thereby limiting the depth of the penetration of the drive head 202 into the drive aperture 312. FIG. 16*c* shows the ram 300 installed and turned until the lower support sole 306 engages the surface 2. FIG. 16*d* shows the drive wrench 200 removed and the securing fastener 350 in the ready position. FIG. 16*e* shows the fastener 350 installed through the center pass through 324 into the surface 2.

Figure 17:
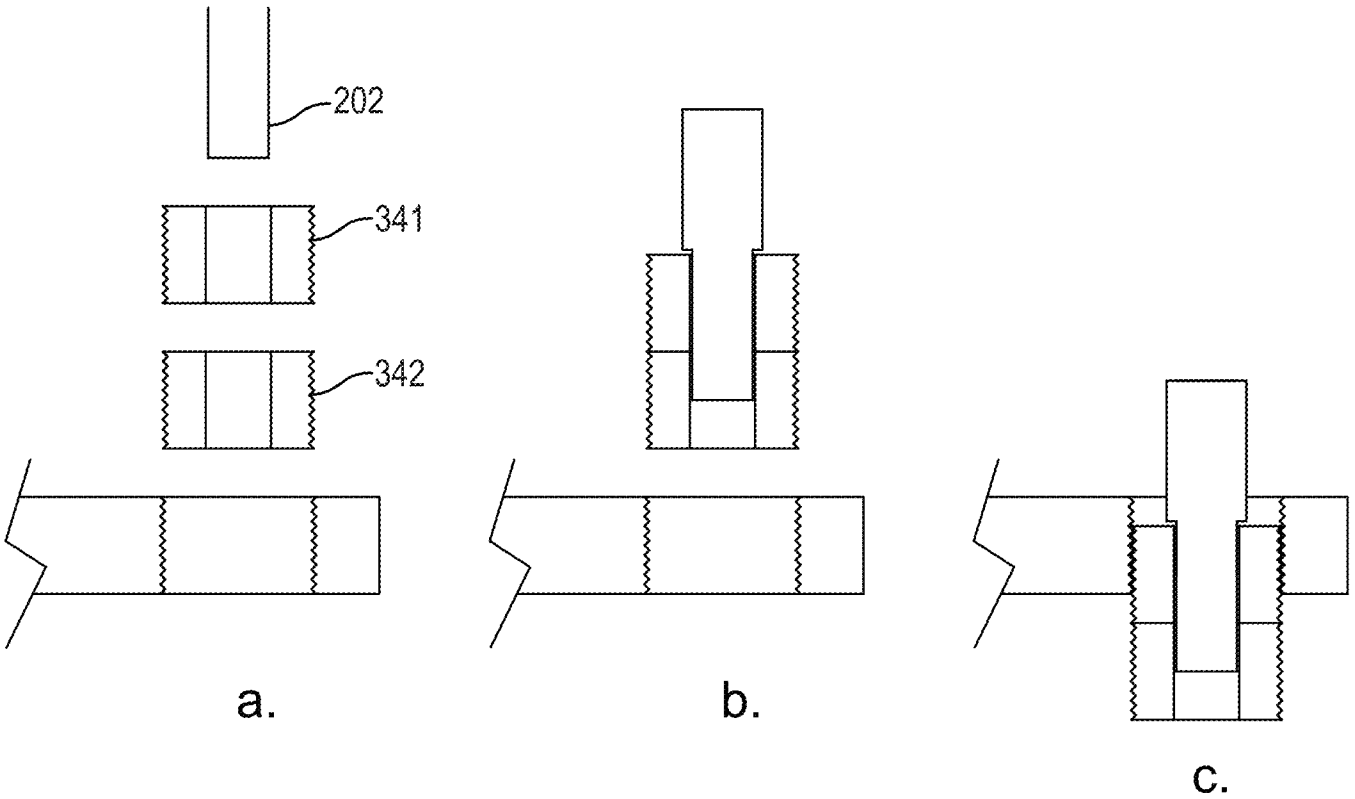
FIG. 17 shows a schematic cut away view of the installation of multiple base bodies.

FIG. 17 shows how multiple socket bodies 310 including a first stacked socket body 341 and a second stacked socket body 342 can be stacked with both of them being driven by a long drive head 202 that passes through the first stacked socket body 341 and into the second stacked socket body 342. FIG. 17*a* is the exploded view, FIG. 17*b* shows the ram bodies 341, 342 stacked an positioned on the drive head 202, and FIG. 17*c* shows them installed through the base body 110.

Figure 18:
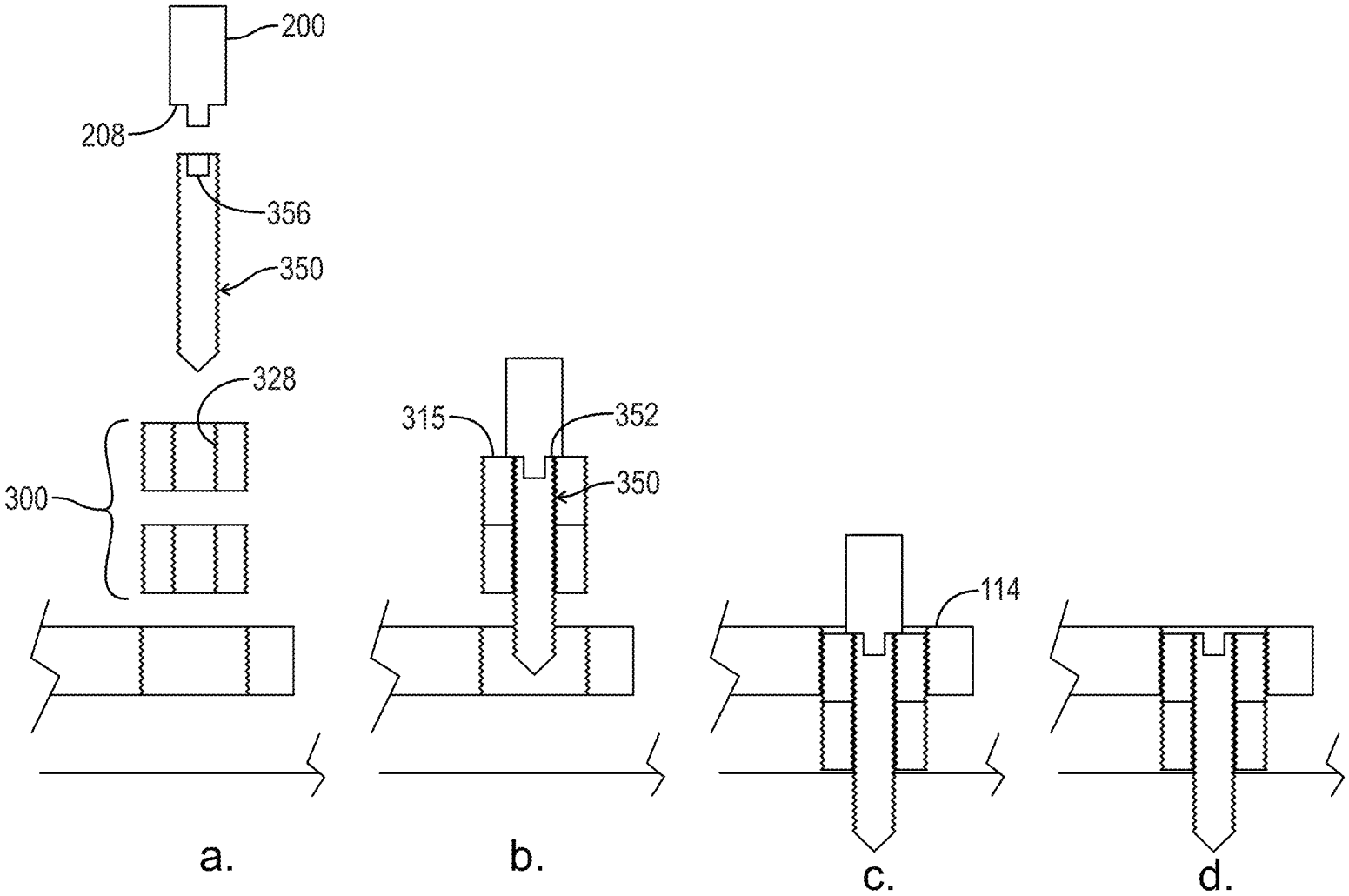
FIG. 18 shows a schematic cut away view of the progression during installation of the ram and with smaller-than-shank recessed drive aperture.
Figure 19:
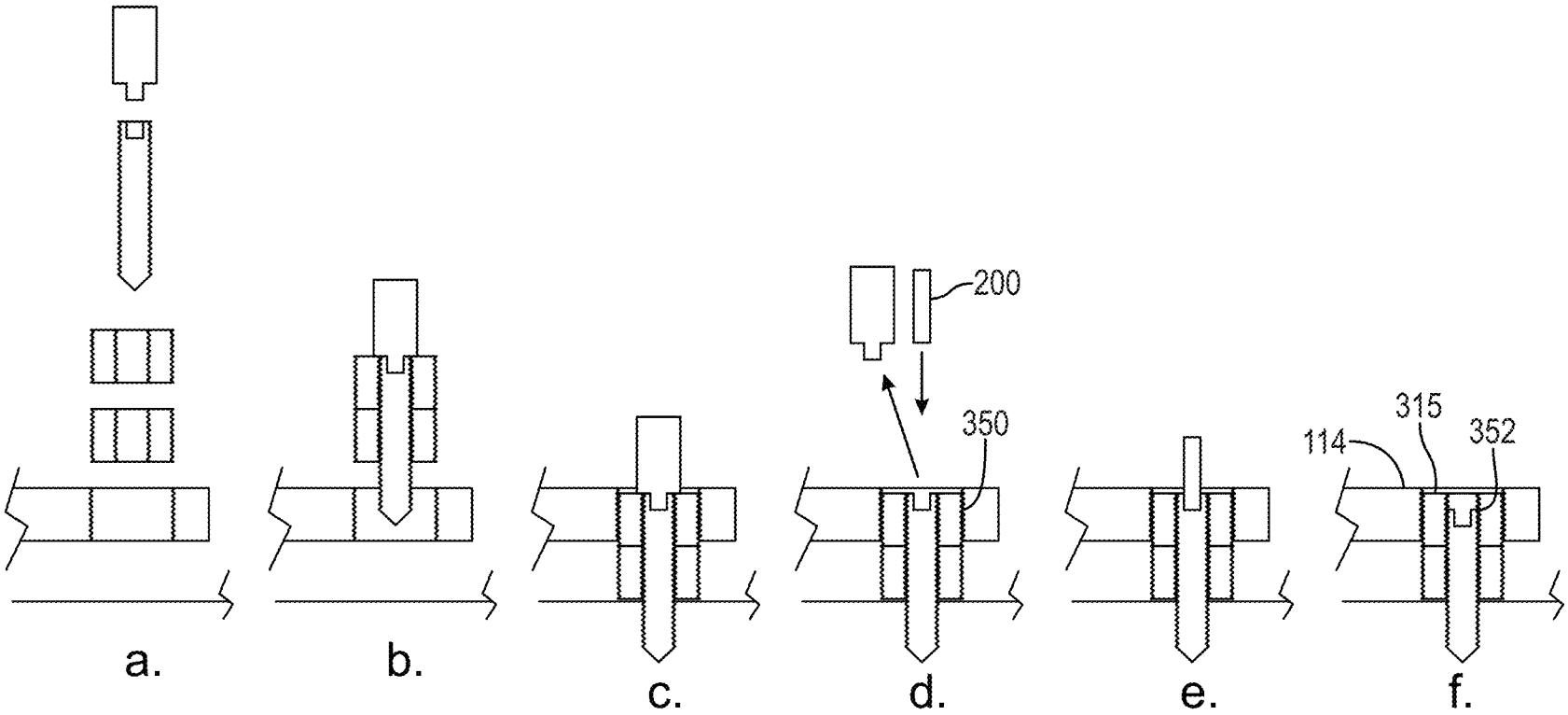
FIG. 19 shows the independent nature of the base top, socket top, and fastener head top.

FIGS. 18 and 19 then shows how center threads 328 can be used with a smaller-than-shank recessed drive aperture 356 in the fastener 350 to allow for complete independent positioning of the fastener 350. FIG. 18 begins with an exploded view in FIG. 18*a*, shows how to use a drive wrench 200 with a drive shoulder 208 to position both the ram 300 and the securing fastener 350 in FIG. 18*b*, shows how to install the stacked assembly into the base body in FIG. 18*c* and shows the final support off of the surface in FIG. 18*d*. FIG. 19 reapts this and then shows how to use a second drive wrench 200 without a drive shoulder 208 to separately adjust the securing fastener 350 independently from the post ram pedestal 100 FIG. 19*d, e*, and the final position in FIG. 19*f*. Now one can see independent adjustment beginning with previously shown FIG. 14, where the securing fastener 350 can have the head top 352 above the socket top 315. FIG. 18 shows in FIG. 18*b* where the securing fastener 350 has the head top 352 is equal to the socket top 315, and FIG. 19*f*. shows how the securing fastener 350 can have the head top 352 below the socket top 315. Thus, FIGS. 14, 18 and 19 show the independent nature of the base top 114, socket top 315, and fastener head top 352. Thus, the securing fasteners 350 can be height adjusted with the head top 352 above, at, and below the both socket top 315 and the base top 114.

REFERENCE NUMERALS USED THROUGHOUT THE DETAILED DESCRIPTION AND THE DRAWINGS CORRESPOND TO THE FOLLOWING ELEMENTS

- Adjustable post base 1
- Surface 2
- Support post 10
  - Post body 12
    - Post base 14
    - Exterior wall 16
      - Hollow core aperture 18
    - Post top 20
- Connecting weld 50
- Post ram pedestal 100
  - Base body 110
    - Body depth 112
    - Base top 114
      - Top central pad 116
        - Post connection area 118
      - Top mounting deck 120
        - Recessed securing apertures 122
        - Aperture diameter 124
        - Aperture depth 126
        - First aperture 128
        - First internal base ram thread 130
        - Second aperture 132
        - second internal base ram thread 134
        - Third aperture 136
        - third internal base ram thread 138
        - Fourth aperture 140
        - Fourth internal base ram thread 142
    - Base bottom 150
    - Body side 160
      - Base left 162
      - Base right 164
      - Base front 166
      - Base back 168
- Drive wrench 200
  - Drive head 202
    - Drive shape 204
    - Head width 206
  - Drive shoulder 208
    - Shoulder diameter 210
- Recessed socket lifting ram 300
  - First screw ram 302
  - Second screw ram 304
  - Third screw ram 306
  - Fourth screw ram 308
  - Socket body 310
    - Body diameter 312
    - Body height 314
    - socket top 315
    - Lower Support sole 316
    - Socket Side wall 318
      - External socket ram threads 320 drive aperture 322
center pass through 324
pass through diameter 326
center threads 328
tool drive section 330
wrench drive wall 332
Upper end 334
first stacked socket body 341
second stacked socket body 342
Securing fastener 350
Fasteter head 352
Head top 353
Head diameter 354
Recess drive aperture 356
Elongated fastener body 360
Body diameter 362
Fastener screw threads 364
Fastener penetrating tip 366
First securing fastener 371
Second securing fastener 372
Third securing fastener (not shown)
Fourth securing fastener 374

From the foregoing, it will be seen that this invention is well adapted to obtain all the ends and objects herein set forth, together with other advantages which are inherent to the structure. It will also be understood that certain features and subcombinations are of utility and may be employed without reference to other features and subcombinations. This is contemplated by and is within the scope of the claims. Many possible embodiments may be made of the invention without departing from the scope thereof. Therefore, it is to be understood that all matter herein set forth or shown in the accompanying drawings is to be interpreted as illustrative and not in a limiting sense.

When interpreting the claims of this application, method claims may be recognized by the explicit use of the word 'method' in the preamble of the claims and the use of the 'ing' tense of the active word. Method claims should not be interpreted to have particular steps in a particular order unless the claim element specifically refers to a previous element, a previous action, or the result of a previous action. Apparatus claims may be recognized by the use of the word 'apparatus' in the preamble of the claim and should not be interpreted to have 'means plus function language' unless the word 'means' is specifically used in the claim element. The words 'defining,' 'having,' or 'including' should be interpreted as open ended claim language that allows additional elements or structures. Finally, where the claims recite "a" or "a first" element of the equivalent thereof, such claims should be understood to include incorporation of one or more such elements, neither requiring nor excluding two or more such elements.

The invention claimed is:

1. A post support for a post on a surface, the post support comprising: a post ram pedestal including a
a base body including a base bottom and a base top defining a first securing aperture having a base thread;
a recessed socket lifting ram including a first socket body including a socket top,
the first socket body defining external socket ram threads sized to mate with the base thread,
the socket body having a maximum body diameter fitting inside the base thread,
the socket body defining a center pass through; and
the socket top defining a drive shape,
wherein the recessed socket lifting ram adjustably extends from the base bottom.

2. The post support of claim 1, further comprising:
the base body further defining a second securing aperture and a third securing aperture.

3. The post support of claim 1, further comprising:
the base body having a base depth; and
the socket body having a socket depth equal to the base depth.

4. The post support of claim 1, further comprising:
the recessed socket lifting ram at least partially positioned within the first securing aperture; and
the socket top positioned at the base top.

5. The post support of claim 1, further comprising:
the recessed socket lifting ram at least partially positioned within the first securing aperture; and
the socket top positioned below the base top.

6. The post support of claim 1, further comprising:
wherein the center pass through is defined as at least a portion of the drive shape.

7. The post support of claim 1, further comprising:
the drive shape selected from a shape group including a slotted drive shape, a cruciform drive shape, a square drive shape, a multiple-square drive shape, an internal hex drive shape, a pentalobular drive shape, a hexalobular drive shape, a combination drive shape, an external drive shape, and a tamper-resistant drive shape.

8. The post support of claim 1, further comprising:
the base top including a stop shoulder.

9. The post support of claim 1, further comprising:
a fastener having head diameter fitting inside the base thread.

10. The post support of claim 1, further comprising:
a fastener having a shank diameter fitting inside the center pass through.

11. The post support of claim 1, further comprising:
a fastener having recess drive aperture fitting inside a shank diameter
the fastener having head top positioned below the base top.

12. The post support of claim 1, further comprising:
a fastener connecting the first socket body to the surface.

13. The post support of claim 1, further comprising:
the recessed socket lifting ram including a second socket body.

14. The post support of claim 13, further comprising:
a fastener connecting the first socket body to the second socket body.

15. The post support of claim 13, further comprising:
a fastener connecting the second socket body to the surface.

16. The post support of claim 13, further comprising:
a fastener extending through the first socket body and the second socket body.

17. The post support of claim 1, the post support further comprising:
a post connected to the post ram pedestal.

18. The post support of claim 1, the post support further comprising:
the post including a post body; and
a connecting weld connecting the post body to the post ram pedestal.

* * * * *